US006877466B2

(12) United States Patent
Shindou et al.

(10) Patent No.: US 6,877,466 B2
(45) Date of Patent: Apr. 12, 2005

(54) VARIABLE VALVE OPERATING SYSTEM FOR INTERNAL COMBUSTION ENGINE

(75) Inventors: Shigeki Shindou, Yokohama (JP); Masaki Toriumi, Yokohama (JP); Yusuke Takagi, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/780,656

(22) Filed: Feb. 19, 2004

(65) Prior Publication Data

US 2004/0168659 A1 Sep. 2, 2004

(30) Foreign Application Priority Data

Feb. 28, 2003 (JP) ..... 2003-052332

(51) Int. Cl.[7] ..... F01L 1/34

(52) U.S. Cl. ..... 123/90.16; 123/90.15; 123/90.17; 123/90.31

(58) Field of Search ..... 123/90.15, 90.16, 123/90.17, 90.18, 90.31, 90.27

(56) References Cited

U.S. PATENT DOCUMENTS 5,626,108 A * 5/1997 Kato et al. ..... 123/90.15
6,401,675 B1 * 6/2002 Nakamura et al. ..... 123/90.15
6,647,935 B2 * 11/2003 Aoyama et al. ..... 123/90.16

FOREIGN PATENT DOCUMENTS

| | | |
|---|---|---|
| JP | 5-98916 A | 4/1993 |
| JP | 8-177426 A | 7/1996 |
| JP | 8-177433 A | 7/1996 |

* cited by examiner

*Primary Examiner*—Thomas Denion
*Assistant Examiner*—Ching Chang
(74) *Attorney, Agent, or Firm*—Foley & Lardner LLP

(57) ABSTRACT

A variable valve operating system for a two-bank engine includes a variable valve-lift and working-angle control mechanism changing at least one of a valve lift and a working angle of each of engine valves arranged in each of cylinder banks, and two variable valve timing control mechanisms provided for each of the banks for changing valve timings independently of each other. A control unit responds a failure in one of the variable valve timing control mechanisms for failsafe purposes. The control unit includes a failsafe section capable of executing a failsafe operating mode in which at least one of the valve lift and the working angle of each of engine valves is increasingly compensated for by the variable valve-lift and working-angle control mechanism, when the one variable valve timing control mechanism is failed.

16 Claims, 8 Drawing Sheets

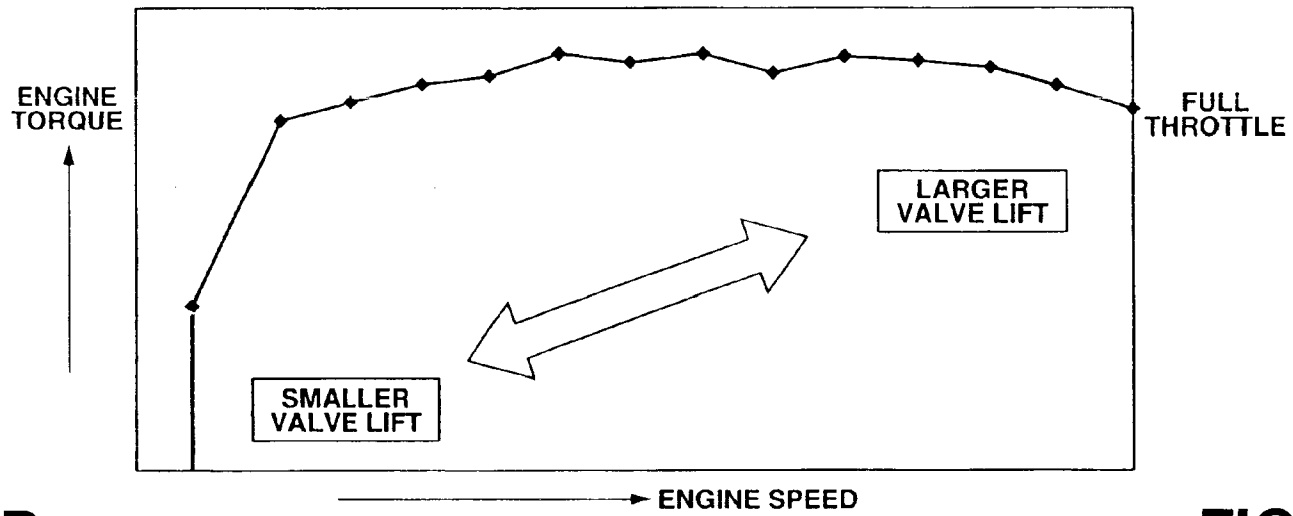
FIG.6A
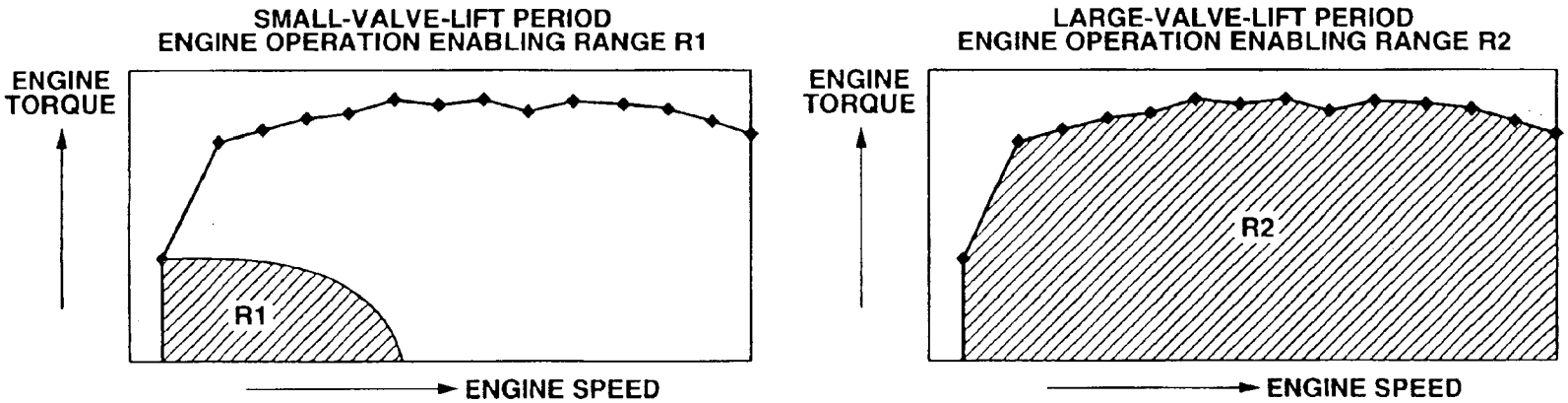
FIG.6B
FIG.6C

VARIABLE VALVE OPERATING SYSTEM FOR INTERNAL COMBUSTION ENGINE

TECHNICAL FIELD

The present invention relates to a variable valve operating system for an internal combustion engine, and specifically to a fail-safe technology in presence of a failure in a variable valve operating system enabling a variable valve timing control function and a variable valve-lift/working-angle control function.

BACKGROUND ART

In recent years, there have been proposed and developed various fail-safe technologies for variable valve timing control systems. One such fail-safe technology has been disclosed in Japanese Patent Provisional Publication No. 5-98916 (hereinafter is referred to as "JP5-98916").

In the variable valve timing control system disclosed in JP5-98916, two variable valve timing control mechanisms are respectively arranged in two cylinder banks for a V-type internal combustion engine. When a failure or malfunction of the variable valve timing control mechanism arranged in a first bank of the two cylinder banks is detected, a desired valve timing of the variable valve timing control mechanism arranged in the second bank is forcibly adjusted or brought closer to an actual valve timing of the variable valve timing control mechanism that is arranged in the first bank and fails to function properly. This effectively avoids valve timings of the two cylinder banks from undesirably fluctuating and unbalancing to each other, even in presence of a failure in the variable valve timing control mechanism or a valve timing control system failure, and thus prevents an extremely unstable state of the engine from occurring.

Later automotive vehicles often employ a variable valve lift and working angle control mechanism as well as a variable valve timing control mechanism. Generally, there are two types of variable valve lift and working angle control mechanisms, namely, one being a high-speed cam/low-speed cam switching system in which a valve lift and a working angle are both variable by switching between a high-speed cam enabling a large working angle and a large valve lift and a low-speed cam enabling a small working angle and a small valve lift, and the other being a so-called continuous variable valve event and lift control system, often abbreviated to "VEL", in which a valve lift and a working angle are both continuously simultaneously variably controlled.

When a plurality of variable valve timing control mechanisms arranged in respective cylinder banks of a multi-cylinder-bank engine and a variable valve lift and working angle control mechanism common to the cylinder banks are combined with each other, it is possible to increase a degree of freedom of setting of valve lift characteristics of engine valves (intake and exhaust valves), thus ensuring improved fuel economy, that is, reduced fuel consumption and enhanced engine performance such as increased engine power output and enhanced combustion stability. The avoidance of degraded engine performance (a drop in engine output torque), which may occur owing to unbalanced valve timings, would be desirable even in presence of a failure in a certain variable valve timing control mechanism or a malfunction in a variable valve timing control system, on internal combustion engines equipped with a plurality of variable valve timing control mechanisms and a variable valve lift and working angle control mechanism combined with each other.

SUMMARY OF THE INVENTION

Accordingly, it is an object of the invention to provide a variable valve operating system for an internal combustion engine with a plurality of variable valve timing control mechanisms and a variable valve lift and working angle control mechanism, capable of effectively suppressing or avoiding a degradation in engine performance, such as a lack of engine output torque, from occurring owing to unbalanced valve timings of the variable valve timing control mechanisms functioning properly and improperly, by way of optimal control for respective operating states of the variable valve timing control mechanisms and the variable valve lift and working angle control mechanism functioning properly, even in presence of a variable valve timing control mechanism failure or a variable valve timing control system failure.

In order to accomplish the aforementioned and other objects of the present invention, a variable valve operating system for an internal combustion engine with at least two cylinder banks comprises a variable valve-lift and working-angle control mechanism that changes at least one of a valve lift and a working angle of each of engine valves arranged in each of the cylinder banks, at least two variable valve timing control mechanisms provided for each of the cylinder banks, for changing a valve timing of each of the engine valves arranged in one bank of the cylinder banks and a valve timing of each of the engine valves arranged in the other bank independently of each other, and a control unit configured to be electronically connected to the variable valve-lift and working-angle control mechanism and the variable valve timing control mechanisms for responding a failure in one of the variable valve timing control mechanisms for failsafe purposes, the control unit comprising a first failsafe section capable of executing a first failsafe operating mode in which at least one of the valve lift and the working angle of each of engine valves is increasingly compensated for by the variable valve-lift and working-angle control mechanism, when the one variable valve timing control mechanism is failed.

According to another aspect of the invention, a variable valve operating system for an internal combustion engine comprises a variable valve-lift and working-angle control mechanism that changes at least one of a valve lift and a working angle of each of engine valves, at least two variable valve timing control mechanisms that change valve timings independently of each other, and a control unit configured to be electronically connected to the variable valve-lift and working-angle control mechanism and the variable valve timing control mechanisms for responding a failure in one of the variable valve timing control mechanisms for failsafe purposes, the control unit comprising a first failsafe section capable of executing a first failsafe operating mode in which at least one of the valve lift and the working angle of each of engine valves is increasingly compensated for by the variable valve-lift and working-angle control mechanism, when the one variable valve timing control mechanism is failed.

According to a further aspect of the invention, a variable valve operating system for an internal combustion engine with at least two cylinder banks comprises a variable valve-lift and working-angle control mechanism that changes at least one of a valve lift and a working angle of each of engine valves arranged in each of the cylinder banks, at least two variable valve timing control mechanisms provided for each of the cylinder banks, for changing a valve timing of each of the engine valves arranged in one bank of the cylinder banks and a valve timing of each of the engine valves arranged in the other bank independently of each other, and a control unit configured to be electronically connected to the variable valve-lift and working-angle control mechanism and the variable valve timing control mechanisms for responding a failure in one of the variable valve timing control mechanisms for failsafe purposes; the control unit comprising malfunction detection means for determining whether one of the variable valve timing control mechanisms is failed, and failsafe means for executing a failsafe operating mode in which at least one of the valve lift and the working angle of each of engine valves is increasingly compensated for by the variable valve-lift and working-angle control mechanism, when the one variable valve timing control mechanism is failed.

According to a still further aspect of the invention, a method of executing failsafe functions for a variable valve operating system for a multi-bank internal combustion engine employing a variable valve-lift and working-angle control mechanism changing at least one of a valve lift and a working angle of each of engine valves arranged in each of cylinder banks, and at least two variable valve timing control mechanisms provided for each of the cylinder banks for changing a valve timing of each of the engine valves arranged in one bank of the cylinder banks and a valve timing of each of the engine valves arranged in the other bank independently of each other, the method comprises detecting whether one of the variable valve timing control mechanisms is failed, and executing a first failsafe operating mode in which at least one of the valve lift and the working angle of each of engine valves is increasingly compensated for by the variable valve-lift and working-angle control mechanism, when the one variable valve timing control mechanism is failed.

According to another aspect of the invention, a method of executing failsafe functions for a variable valve operating system for an internal combustion engine employing a variable valve-lift and working-angle control mechanism changing at least one of a valve lift and a working angle of each of engine valves, and at least two variable valve timing control mechanisms changing valve timings independently of each other, the method comprises detecting whether one of the variable valve timing control mechanisms is failed, and executing a first failsafe operating mode in which at least one of the valve lift and the working angle of each of engine valves is increasingly compensated for by the variable valve-lift and working-angle control mechanism, when the one variable valve timing control mechanism is failed.

The other objects and features of this invention will become understood from the following description with reference to the accompanying drawings.

BRIEF DESCRIPTION OF THE DRAWINGS

FIG. 6A is a characteristic diagram showing the relationship among engine speed, engine torque, and valve lift.

FIG. 6B is an engine-speed versus engine-torque characteristic diagram showing a small-valve-lift period engine operation enabling range R1.

FIG. 6C is an engine-speed versus engine-torque characteristic diagram showing a large-valve-lift period engine operation enabling range R2.

DESCRIPTION OF THE PREFERRED EMBODIMENTS

Figure 1:
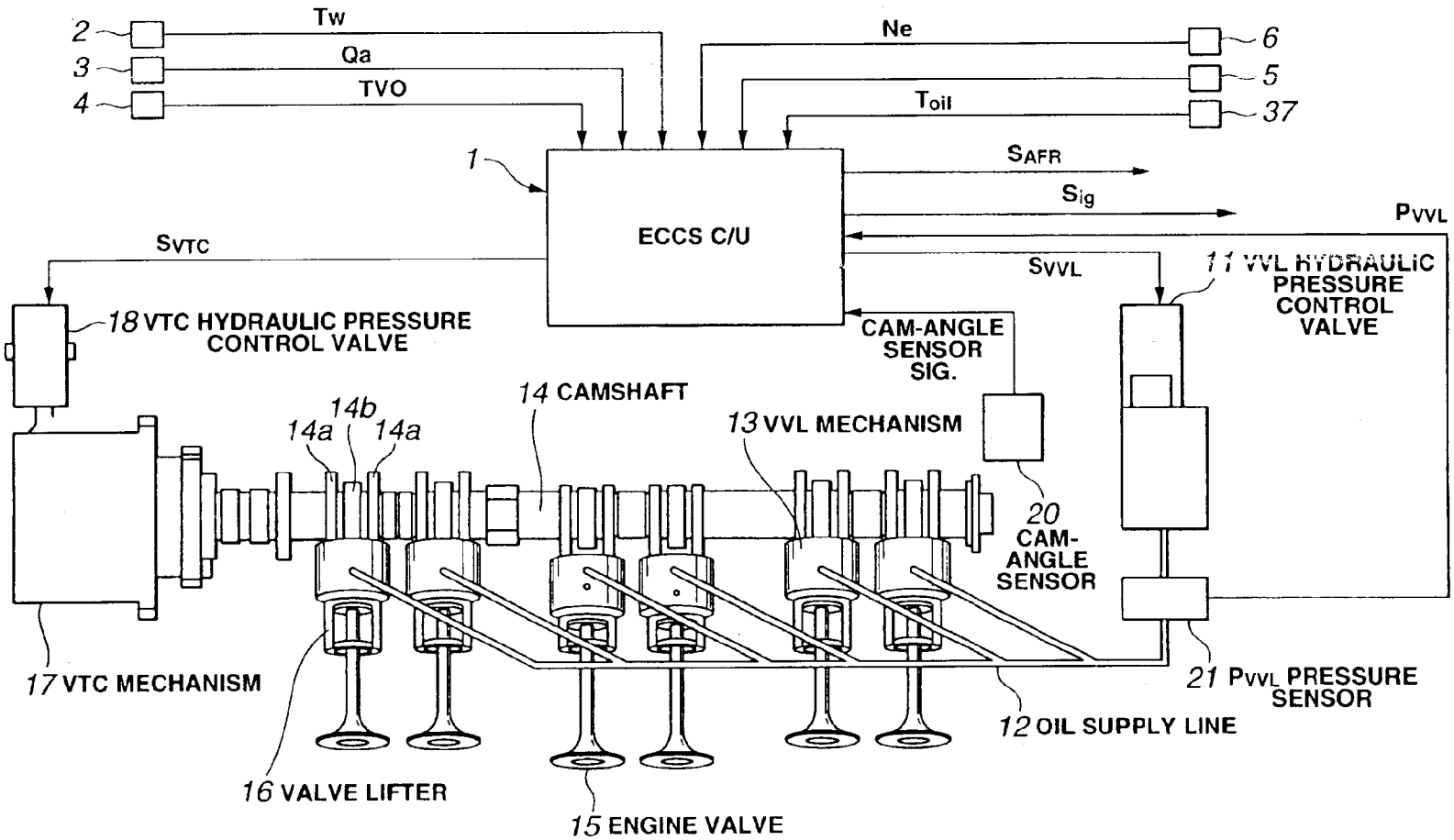
FIG. 1 is a system block diagram illustrating an embodiment of a variable valve operating system for an internal combustion engine equipped with two cylinder banks each having a variable valve timing control (VTC) mechanism and a variable valve-lift and working-angle control (VVL) mechanism.

Referring now to the drawings, particularly to FIG. 1, the variable valve operating system of the embodiment is exemplified in a V-type, double-overhead-camshaft internal combustion engine with two camshafts per cylinder bank.

As shown in FIG. 1, the variable valve operating system of the embodiment is comprised of a hydraulically-operated variable valve-lift and working-angle control (VVL) mechanism 13 through which a valve lift and a working angle of each of intake valves 15 are both varied, and a plurality of hydraulically-operated variable valve timing control (VTC) mechanisms 17A and 17B, which are collectively referred to as "VTC mechanism 17", arranged in the respective cylinder banks. VTC mechanism 17 is provided for varying a valve timing of each of intake valves 15. Typical detailed construction of such VVL mechanism 13 has been disclosed, for example, in Japanese Patent Provisional Publication No. 8-177433, whereas typical detailed construction of such VTC mechanism 17 has been disclosed, for example, in Japanese Patent Provisional Publication No. 8-177426. As VVL mechanism 13, the variable valve operating system of the shown embodiment uses a high-speed cam/low-speed cam switching system in which a valve lift and a working angle are both varied by switching from one of a high-speed cam 14*a* and a low-speed cam 14*b* to the other. High-speed cam 14*a* is mounted on a camshaft 14 for enabling a large working angle and a large valve lift for each intake valve 15, whereas low-speed cam 14*b* is mounted on camshaft 14 for enabling a small working angle and a small valve lift for each intake valve 15. Although it is not clearly shown in FIG. 1, a high-speed cam/low-speed cam switching mechanism is attached to a valve lifter 16 of each intake valve 15, for switching between a high-speed cam operating mode and a low-speed cam operating mode depending on engine operating conditions. That is, in the shown embodiment, VVL mechanism 13 can provide a two-stage valve-lift and working-angle characteristic. In lieu thereof, another type of variable valve lift and working angle control mechanism, such as continuous variable valve event and lift control system (VEL), capable of continuously simultaneously varying a valve-lift and working-angle characteristic, may be used. On the other hand, VTC mechanism 17 includes an inner housing rotating together with intake-valve camshaft 14, an outer housing rotating together with a cam pulley to which torque is transmitted from an engine crankshaft via a timing belt, and a relative-phase changing mechanism disposed between the inner and outer housings. A phase angle of the inner housing relative to the outer housing can be varied depending on a pressure value of hydraulic pressure applied to VTC mechanism 17. In other words, a valve timing of each intake valve 15 arranged in can be continuously varied by changing an angular phase at a central angle corresponding to a maximum valve lift point of intake valve 15 depending on a pressure value of hydraulic pressure applied to VTC mechanism 17.

The hydraulic pressure applied to VVL mechanism 13 is controlled or regulated by means of a VVL hydraulic pressure control valve 11, whereas the hydraulic pressure applied to VTC 17 is controlled or regulated by means of a VTC hydraulic pressure control valve 18. In the system of the embodiment, each of pressure control valves 11 and 18 is comprised of an electromagnetically-operated solenoid valve. The operations of pressure control valves 11 and 18 are respectively controlled in response to a VTC control signal $S_{VTC}$ and a VVL control signal $S_{VVL}$, both generated from an electronic control unit (ECU) 1. ECU 1 generally comprises a microcomputer. ECU 1 includes an input/output interface (I/O), memories (RAM, ROM), and a microprocessor or a central processing unit (CPU). The input/output interface (I/O) of ECU 1 receives input information from various engine/vehicle sensors, namely, an engine temperature sensor (engine coolant temperature sensor) 2, an intake-air quantity sensor (airflow meter) 3, a throttle opening sensor (throttle position sensor) 4, an air/fuel ratio (AFR) sensor ($O_2$ sensor) 5, a crankangle sensor 6, a camshaft position sensor (cam-angle sensor) 20, a VVL pressure sensor 21, a hydraulic pressure sensor 36 (see FIG. 2), and an oil temperature sensor 37. Engine temperature sensor 2 is provided to detect engine temperature (coolant temperature) Tw. Intake-air quantity sensor 3 is provided to detect a quantity Qa of air drawn into the engine. Throttle position sensor 4 is provided to detect a throttle opening TVO. AFR sensor 5 is provided to detect or monitor the percentage of oxygen contained within engine exhaust gases at all times when the engine is running. Crankangle sensor 6 is provided to inform ECU 1 of the engine speed Ne as well as the relative position of the engine crankshaft. Cam-angle sensor 20 is provided to inform ECU 1 of the cam angle and to initiate the correct ignition timing sequence as per the engine firing order, as well as the fuel-injection timing. VVL pressure sensor 21 is provided to inform ECU 1 of the output pressure $P_{VVL}$ from VVL hydraulic pressure control valve 11. Hydraulic pressure sensor 36 (see FIG. 2) is provided to detect or monitor a hydraulic pressure $P_L$ of pressurized oil from an oil pump 31 (described later in reference to the flow chart of FIG. 7). Oil temperature sensor 37 is provided to sense engine oil temperature Toil. Within ECU 1, the central processing unit (CPU) allows the access by the I/O interface of input informational data signals from the previously-discussed engine/vehicle sensors 2, 3, 4, 5, 6, 20, 21, and 37. The CPU of ECU 1 is responsible for carrying the air/fuel ratio control program, the electronic ignition control program, and the VTC/VVL control program stored in memories and is capable of performing necessary arithmetic and logic operations containing at least the fail-safe routine (VTC/VVL control routine) shown in FIG. 4 (discussed later) or the modified fail-safe routine (modified VTC/VVL control routine) shown in FIG. 7 (discussed later). Computational results (arithmetic calculation results), that is, calculated output signals are relayed through the output interface circuitry of the ECU to output stages. Concretely, an air/fuel ratio control signal $S_{AFR}$ is output from the output interface to an A/F control actuator such as an electronically-controlled throttle actuator. An ignition timing control signal $S_{ig}$ is output from the output interface to an electronic ignition system. A VTC control signal $S_{VTC}$ is output from the output interface to the electromagnetic solenoid of VTC hydraulic pressure control valve 18, whereas a VVL control signal $S_{VVL}$ is output from the output interface to the electromagnetic solenoid of VVL hydraulic pressure control valve 11.

Figure 2:
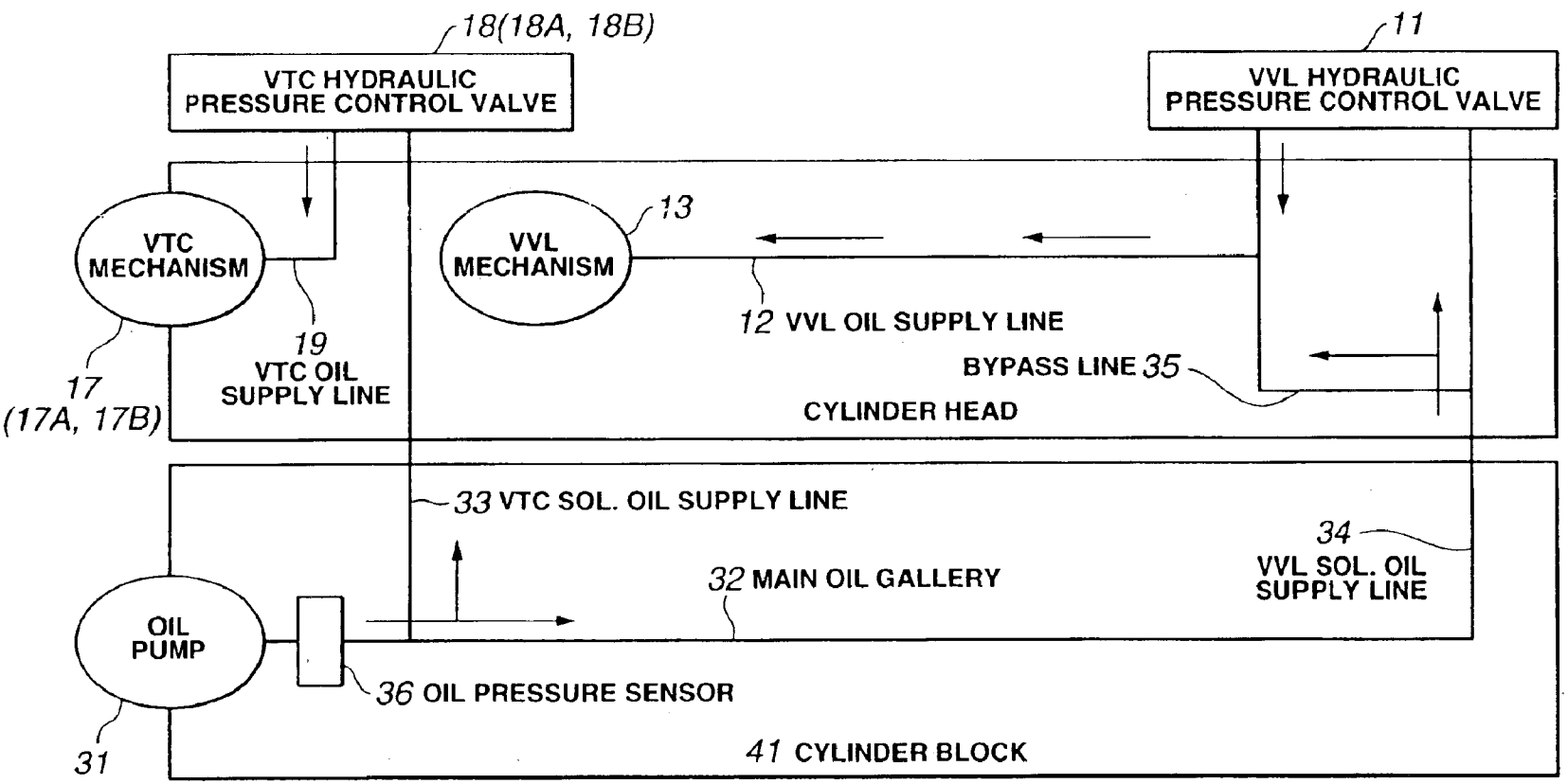
FIG. 2 is a hydraulic circuit diagram for the VTC and VVL mechanisms included in the variable valve operating system of the embodiment.

Referring now to FIG. 2, there is shown the hydraulic circuit for hydraulically-operated VTC and VVL mechanisms 17 and 13. Oil pump 31 serves as a hydraulic pressure source common to VTC and VVL mechanisms 17 and 13. Oil pump 31 is driven by the engine crankshaft to deliver pressurized oil (pressurized working fluid) to a main oil gallery 32 formed in an engine cylinder block 41. The outlet port of oil pump 31 is connected via a VVL solenoid oil supply line 34 to VVL hydraulic pressure control valve 11. VVL hydraulic pressure control valve 11 is connected via a VVL oil supply line 12 to VVL mechanism 13, which is common to intake valves 15 arranged in the first cylinder bank and intake valves 15 arranged in the second cylinder bank. That is, VVL hydraulic pressure control valve 11 is fluidly disposed substantially in a middle of VVL solenoid oil supply line 34 and VVL oil supply line 12 which lines interconnect oil pump 31 and VVL mechanism 13. The outlet port of oil pump 31 is also connected via a VTC solenoid oil supply line 33 to VTC hydraulic pressure control valve 18. VTC hydraulic pressure control valve 18 is also connected via a VTC oil supply line 19 to VTC mechanism 17. That is, VTC hydraulic pressure control valve 18 is fluidly disposed substantially in a middle of VTC solenoid oil supply line 33 and VTC oil supply line which lines interconnect oil pump 31 and VTC mechanism 17. Hydraulic pressure sensor 36 is located at the upstream confluent point of VTC solenoid oil supply line 33 and VVL solenoid oil supply line 34, so as to detect or monitor hydraulic pressure $P_L$ of pressurized oil discharged and generated from oil pump 31. A bypass line 35 is provided to interconnect oil pump 31 and VVL mechanism 13, bypassing VVL hydraulic pressure control valve 11. Bypass line 35 functions to promote a rapid pressure rise in the hydraulic pressure delivered to VVL mechanism 13. In the shown embodiment, an orifice (a fluid-flow constriction means) is further provided in bypass line 35, for preventing a malfunction in VVL mechanism 13, which may occur owing to the hydraulic pressure delivered via bypass line 35 to VVL mechanism 13 when the electromagnetic solenoid of VVL hydraulic pressure control valve 11 is de-energized (switched OFF) and thus fully closed.

Figure 3:
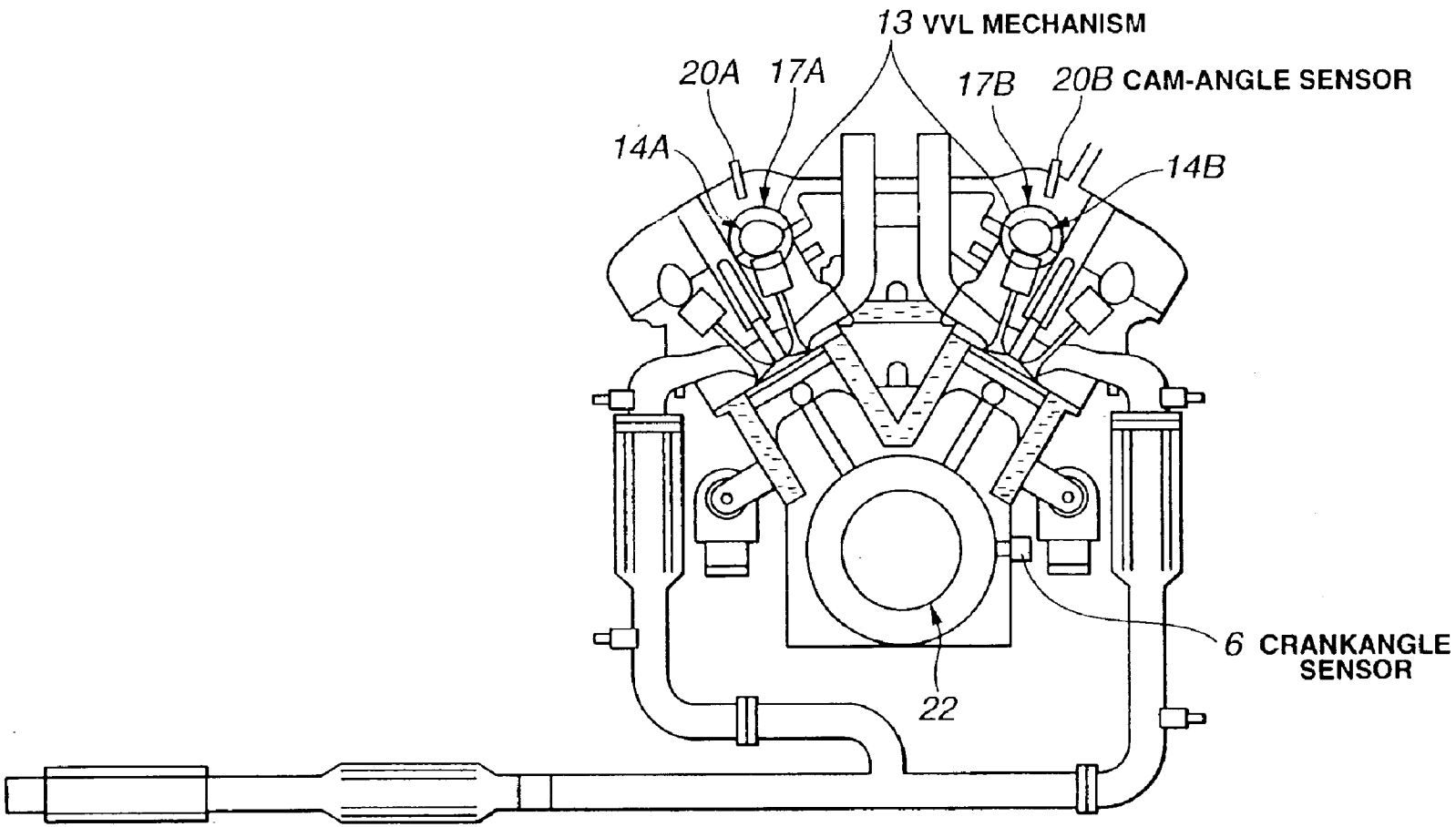
FIG. 3 is a schematic front view of a V-type internal combustion engine in which the variable valve operating system of the embodiment is incorporated.

FIG. 3 shows the view from the front end of the V-type internal combustion engine employing the variable valve operating system of the embodiment. As shown in FIG. 3, the first variable valve timing control mechanism 17A is mounted on a first camshaft 14A arranged in a first bank of two cylinder banks, while the second variable valve timing control mechanism 17B is mounted on a second camshaft 14B arranged in the second bank. Hydraulic pressures delivered to first and second VTC mechanisms 17A and 17B are controlled independently of each other by means of respective VTC hydraulic pressure control valves 18A and 18B, which are collectively referred to as "VTC hydraulic pressure control valve 18". First and second cam-angle sensors 20A and 20B, which are collectively referred to as "cam-angle sensor 20", are located nearby the respective camshafts 14A and 14B, for generating the cam-angle sensor signal regarding a cam angle of first camshaft 14A and the cam-angle sensor signal regarding a cam angle of second camshaft 14B independently of each other.

Figure 4:
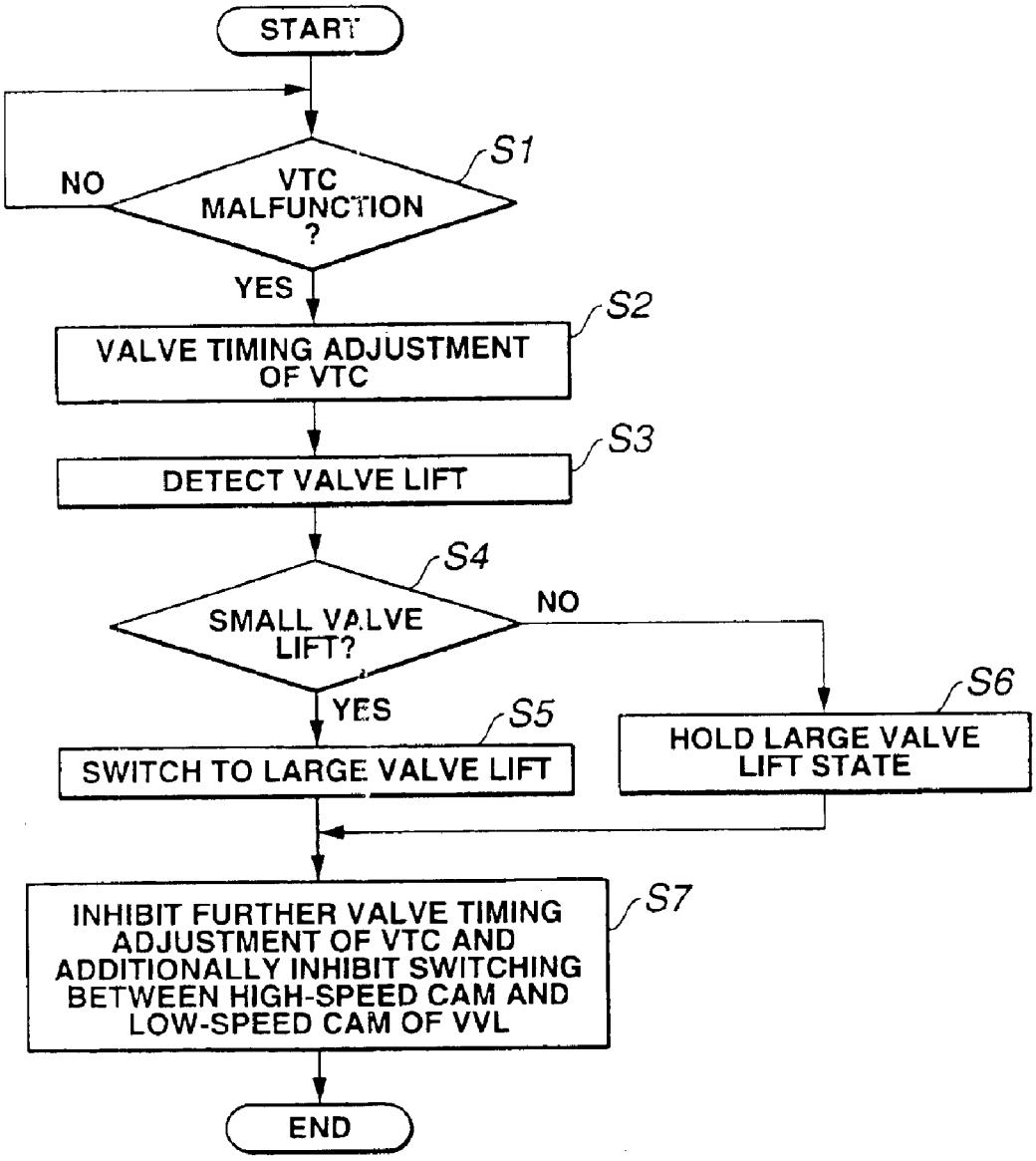
FIG. 4 is a flow chart showing a control routine executed by the variable valve operating system of the embodiment.
Figures 5A, 5B, 5C, 5D, 5E:
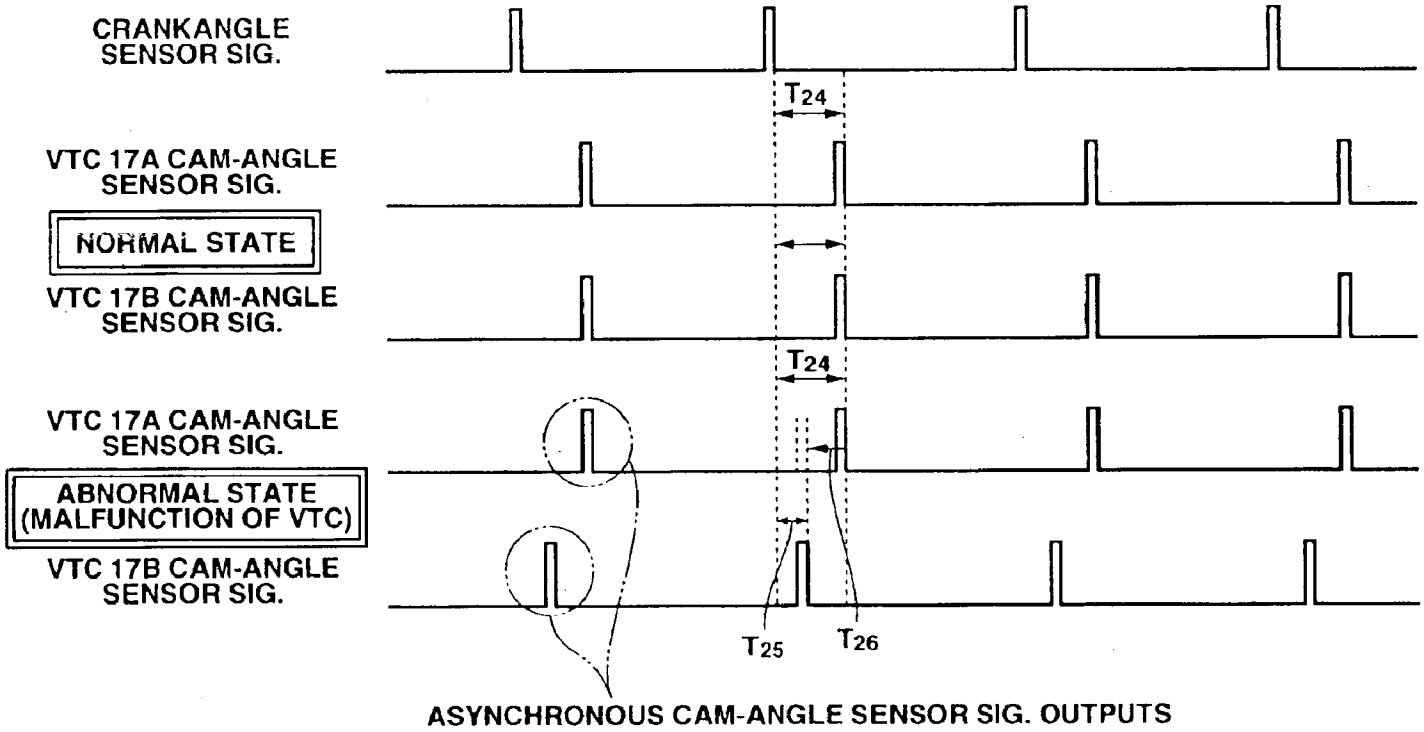
FIGS. 5A–5E are timing charts showing synchronous cam-angle sensor pulse signal outputs from two VTC mechanisms in a normal state and asynchronous cam-angle sensor pulse signal outputs in an abnormal state (or in presence of a failure in one of the VTC mechanisms).

Referring now to FIG. 4, there is shown the fail-safe routine (VTC/VVL control routine) executed by ECU 1 incorporated in the variable valve operating system of the embodiment. The routine of FIG. 4 is executed as time-triggered interrupt routines to be triggered every predetermined time intervals such as 10 milliseconds.

At step S1, a check is made to determine whether a malfunction (or a failure) in either one of first and second VTC mechanisms 17A and 17B occurs. Step S1 serves as a VTC malfunction detection means. When the answer to step S1 is in the affirmative (YES) and thus both of first and second VTC mechanisms 17A and 17B function properly, the routine proceeds from step S1 to step S2. When the answer to step S1 is in the negative (NO), the routine returns to step S1.

At step S2, a desired valve timing of the other VTC mechanism (the unfailed VTC mechanism), which functions properly, is adjusted to the actual valve timing of the one VTC mechanism (the failed VTC mechanism), which functions improperly. This valve timing harmonization between the failed VTC mechanism functioning improperly and the unfailed VTC mechanism functioning properly is effective to avoid degraded engine performance such as a drop in engine output torque and degraded combustion stability which may occur owing to unbalanced valve timings of the respective cylinder banks. The VTC-malfunction detection step S1 and the VTC-mechanism valve-timing-adjustment step S2 are hereinafter described in detail by reference to the time charts shown in FIGS. 5A–5E.

The first VTC mechanism 17A is designed to change the engine valve timing of the first cylinder bank by way of a phase change in first camshaft 14A relative to the crankangle (the angular position of the engine crankshaft), while the second VTC mechanism 17B is designed to change the engine valve timing of the second cylinder bank by way of a phase change in second camshaft 14B relative to the crankangle. Concretely, as can be seen from the time charts of FIGS. 5A–5C, in a normal state of each of first and second VTC mechanisms 17A and 17B, in which VTC mechanisms 17A and 17B function properly and normally, a time interval between a point of time of each pulse of the crankangle sensor signal and a point of time of each pulse of the first cam-angle sensor signal associated with first VTC mechanism 17A, in other words, a phase of the first cam-angle sensor signal output relative to the crankangle sensor signal output is feedback-controlled and brought closer to a desired time interval $T_{24}$. In the normal state (with no malfunction of first and second VTC mechanisms 17A and 17B), a time interval between a point of time of each pulse of the crankangle sensor signal and a point of time of each pulse of the second cam-angle sensor signal associated with second VTC mechanism 17B, in other words, a phase of the second cam-angle sensor signal output relative to the crankangle sensor signal output is also feedback-controlled and brought closer to the same desired time interval $T_{24}$. On the contrary, in an abnormal state in which either one of first and second VTC mechanisms 17A and 17B is failed, as can be seen from the time charts of FIGS. 5D and 5E, for instance, a phase retard of the second cam-angle sensor signal output relative to the crankangle sensor signal output is improperly adjusted to a time interval $T_{25}$ (see FIG. 5E) different from the desired time interval $T_{24}$, while a phase retard of the first cam-angle sensor signal output relative to the crankangle sensor signal output is properly adjusted to the desired time interval $T_{24}$ (see FIG. 5D). When the phase difference $T_{26}$ between the trailing edges of two adjacent cam-angle sensor pulse signal outputs shown in FIGS. 5D and 5E exceeds a predetermined reference value, the processor of ECU 1 determines that the second VTC mechanism 17B mounted on second camshaft 14B is functioning improperly due to various factors, for example, sticking of at least one component part of second VTC mechanism 17B or a failure in the VTC control signal line for second VTC mechanism 17B, and thus there is a malfunction in second VTC mechanism 17B (see step S1). As discussed above, when a failure of either one of first and second VTC mechanisms 17A and 17B has been detected, ECU 1 compensates for the actual valve timing of first VTC mechanism 17A functioning properly, so that the phase of the sensor signal output of first cam-angle sensor 20A (associated with first VTC mechanism 17A functioning properly) relative to the crankangle sensor signal output is feedback-controlled and brought closer to the phase of the sensor signal output of second cam-angle sensor 20B (associated with second VTC mechanism 17B functioning improperly) relative to the crankangle sensor signal output and thus the previously-noted phase difference $T_{26}$ can be eliminated (see step S2).

Returning to FIG. 4, through a series of steps S3–S6 a valve lift and a working angle are adjusted or held at a large valve-lift and working-angle state by means of VVL mechanism 13.

Concretely, at step S3, the latest up-to-date information regarding the actual valve lift of intake valve 15 is detected.

At step S4, a check is made to determine whether the current valve lift detected through step S3 is a small valve lift, in other words, low-speed cam 14*b* having a predetermined small valve-lift and working-angle characteristic is used. When the answer to step S4 is affirmative (YES) and therefore low-speed cam 14*b* is used, the routine flows from step S4 to step S5. Conversely when the answer to step S4 is negative (NO) and therefore high-speed cam 14*a* is used, the routine flows from step S4 to step S6.

At step S5, switching from low-speed cam 14*b* having the predetermined small valve-lift and working-angle characteristic to high-speed cam 14*a* having a predetermined large valve-lift and working-angle characteristic, occurs such that the valve lift and the working angle of intake valve 15 are both increasingly compensated for.

At step S6, the high-speed cam operating mode is continued to hold the large valve-lift and working-angle state, since switching to high-speed cam 14*a* has been already made. After a series of steps S2–S6, step S7 occurs.

At step S7, ECU 1 inhibits further valve timing adjustment of first VTC mechanism 17A functioning normally properly and additionally inhibits switching between high-speed cam 14*a* and low-speed cam 14*b* of VVL mechanism 13.

In order to simplify the control routine shown in FIG. 4, steps S3 and S4 may be eliminated. In this case, when a failure (or a malfunction) of either one of first and second VTC mechanisms 17A and 17B takes place, through step S5 forcible switching to high-speed cam 14*a* must be initiated in response to a command signal from ECU 1 to VVL hydraulic pressure control valve 11 for VVL mechanism 13. As discussed above, according to the fail-safe routine (VTC/VVL control routine) of FIG. 4, in presence of a malfunction in either one of first and second VTC mechanisms 17A and 17B, as a fail-safe operation the variable valve operating system of the embodiment functions to increasingly compensate for at least one of the valve lift and working angle of each of intake valves 15 by means of VVL mechanism 13. The reason for this is hereunder described in detail by reference to the characteristic diagrams shown in FIGS. 6A–6C.

Referring now to FIGS. 6A–6C, there is shown the relationship among the engine speed, engine torque, and valve lift of intake valve 15. As shown in FIG. 6A, generally basically, the lower the engine speed or the engine load (or engine output torque), the smaller the valve lift (and/or the working angle) of intake valve 15 is adjusted. Conversely, the higher the engine speed or the engine load (or engine torque), the larger the valve lift (and/or the working angle) of intake valve 15 is adjusted. As can be appreciated from small-valve-lift period engine operation enabling range R1 shown in the engine-speed versus engine-torque characteristic diagram of FIG. 6B, low-speed cam 14*b* having the predetermined small valve-lift and working-angle characteristic is used within this operating range R1. In an operating range except small-valve-lift period engine operation enabling range R1, high-speed cam 14*a* having the predetermined large valve-lift and working-angle characteristic is used. Low-speed cam 14*b* contributes to reduce a pumping loss in small-valve-lift period engine operation enabling range R1. Assuming that low-speed cam 14*b* is used in a high-speed high-load range, a required engine power output (engine torque) cannot be produced. In other words, low-speed cam 14*b* cannot be practically used in the engine operating range except small-valve-lift period engine operation enabling range R1. On the other hand, high-speed cam 14*a* having the predetermined large valve-lift and working-angle characteristic tends to increase the pumping loss in small-valve-lift period engine operation enabling range R1. However, as can be appreciated from large-valve-lift period engine operation enabling range R2 shown in the engine-speed versus engine-torque characteristic diagram of FIG. 6C, high-speed cam 14*a* can be used in large-valve-lift period engine operation enabling range R2, that is, through all engine operating ranges. As described previously, in presence of a failure in either one of first and second VTC mechanisms 17A and 17B, a valve timing of each intake valve 15 associated with the failed VTC mechanism functioning improperly is offset from its desired valve timing, and therefore there is an increased tendency for unstable engine combustion to occur even when the engine operating condition is a low-speed low-load range and thus low-speed cam 14*b* is selected and used in small-valve-lift period engine operation enabling range R1. According to the system of the embodiment, in presence of such a failure of the VTC mechanism, high-speed cam 14*a* having the predetermined large valve-lift and working-angle characteristic is selected, and thus it is possible to certainly avoid the engine combustion stability from being deteriorated due to an undesirable lack in engine torque.

Figure 7:
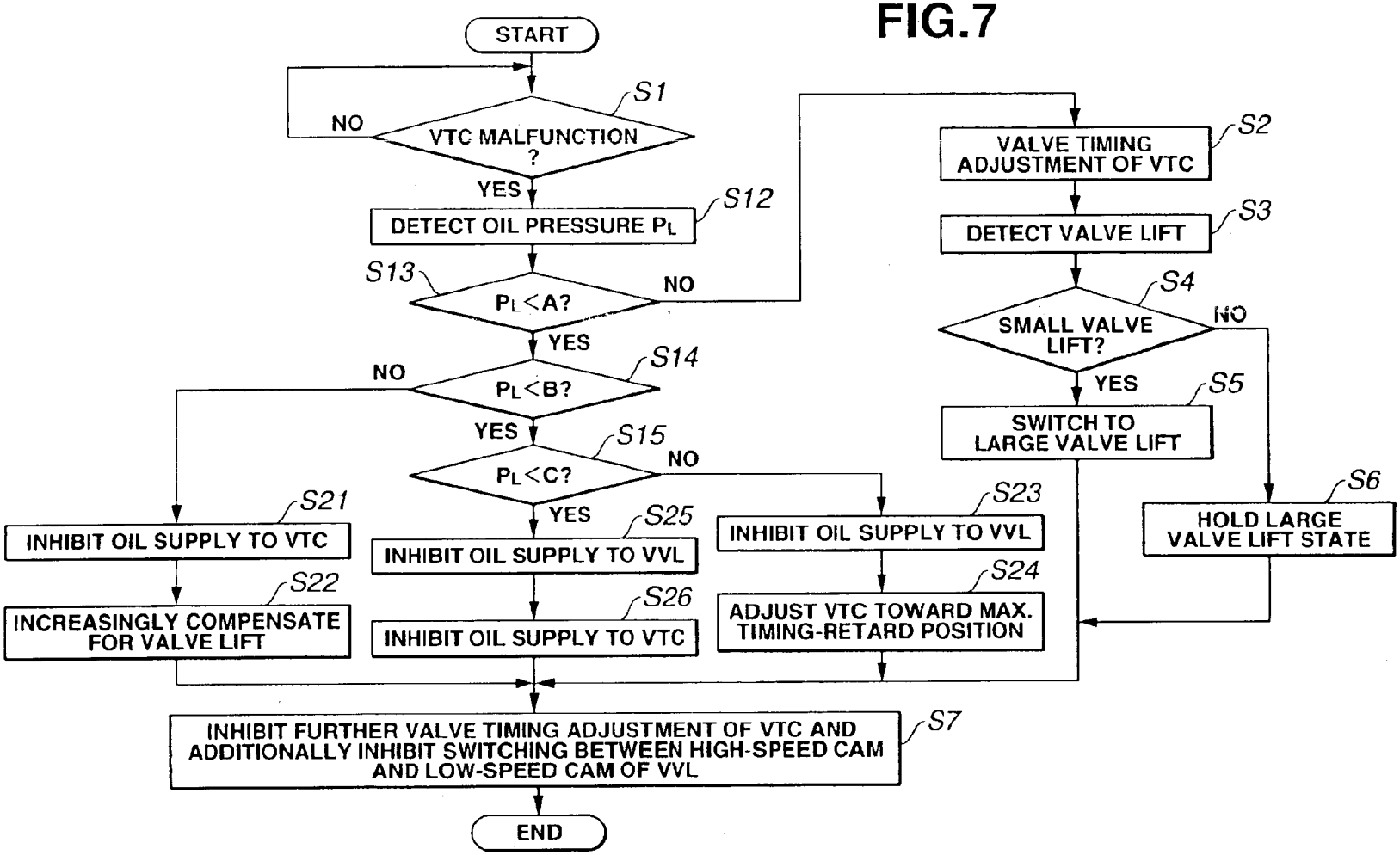
FIG. 7 is a flow chart showing a modified control routine executed by the variable valve operating system of the embodiment.
Figure 8:
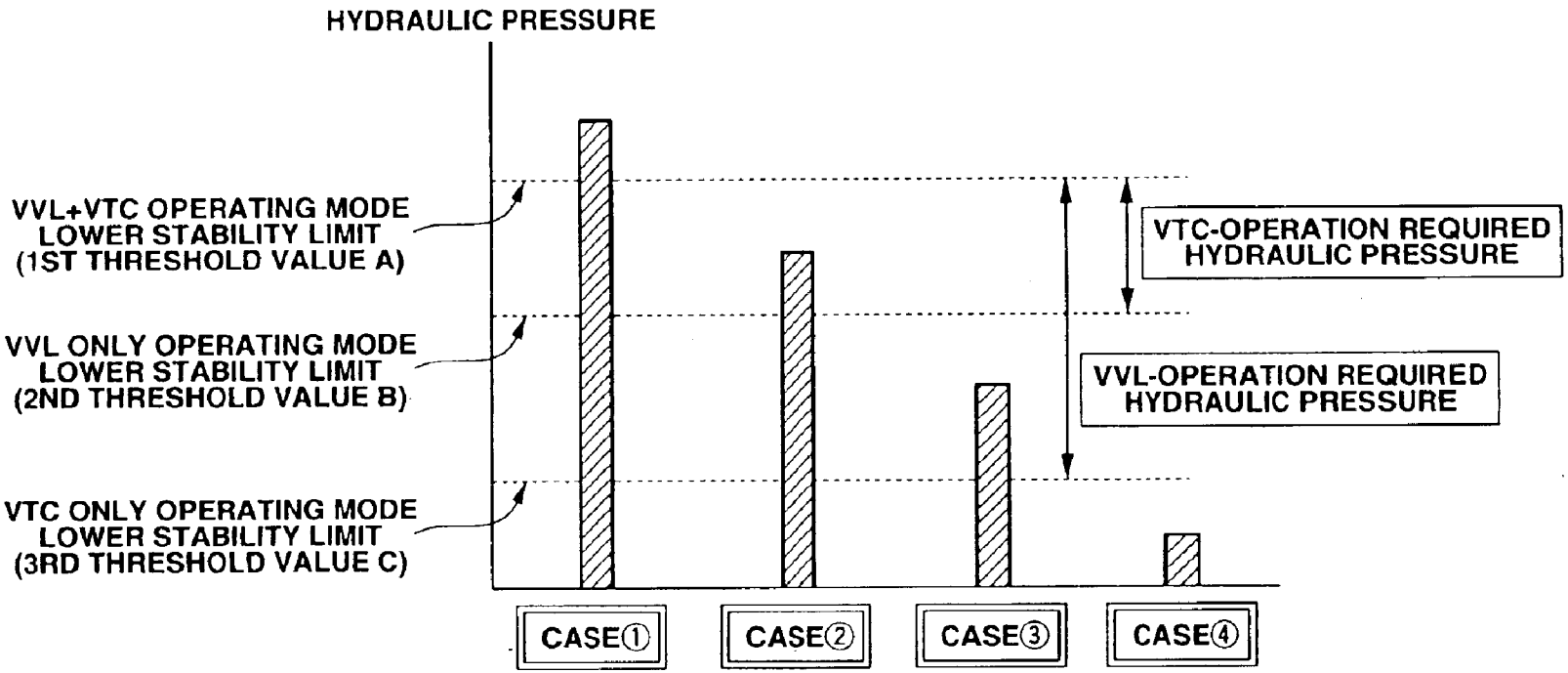
FIG. 8 is an explanatory view showing the relationship among three different hydraulic-pressure threshold values A, B, and C, and four different cases ①, ②, ③, and ④ (four different VVL/VTC control patterns).

Referring now to FIGS. 7 and 8, there is shown the fail-safe operation achieved by the variable valve operating system of the embodiment executing the modified control routine. As is generally known, the hydraulic pressure $P_L$ of pressurized hydraulic fluid discharged from oil pump 31 tends to fluctuate depending on engine operating conditions such as engine speed Ne, engine temperature (engine oil temperature $T_{oil}$), and the like. Suppose that hydraulic pressure $P_L$ of pressurized hydraulic fluid discharged from oil pump 31 is low under a condition where valve timing adjustment of each of first and second VTC mechanisms 17A and 17B and switching operation between high-speed cam 14*a* and low-speed cam 14*b* included in VVL mechanism 13 are both made and additionally a failure in either one of first and second VTC mechanisms 17A and 17B occurs. Owing to such a low hydraulic pressure level, there is a possibility of a malfunction (or a failure) in the other VTC mechanism or a malfunction (or a failure) in VVL mechanism 13. Therefore, as hereinafter described in detail, the system of the embodiment executing the modified control routine of FIG. 7 limits or inhibits the valve timing adjusting operation of the unfailed VTC mechanism functioning properly and/or switching operation between high-speed cam 14*a* and low-speed cam 14*b*, depending on the pressure level of hydraulic pressure $P_L$ estimated or detected.

Concretely, as shown in FIG. 8, an oil-supply area (or a hydraulic-pressure supply area) is classified into four oil-supply zones (or four hydraulic-pressure supply zones), namely first, second, third and fourth cases ①, ②, ③, and ④, by predetermined three threshold values A, B, and C. First threshold value A is determined or set to a VVL+VTC operating mode lower stability limit above which stable oil supply to the other moving engine parts can be ensured, while supplying oil (hydraulic pressure) to both of the VVL mechanism and the unfailed VTC mechanism. Second threshold value B (less than first threshold value A) is determined or set to a VVL only operating mode lower stability limit above which stable oil supply (stable hydraulic-pressure supply) to the VVL mechanism can be ensured with no oil supply to the unfailed VTC mechanism. Third threshold value C (less than second threshold value B) is determined or set to a VTC only operating mode lower stability limit above which stable oil supply (stable hydraulic-pressure supply) to the unfailed VTC mechanism can be ensured with no oil supply to the VVL mechanism.

The details of the modified fail-safe routine further considering fluctuations in hydraulic pressure $P_L$ varying depending on engine operating conditions such as engine speed Ne and engine temperature (engine oil temperature $T_{oil}$), are hereunder discussed in reference to the flow chart shown in FIG. 7. The modified routine shown in FIG. 7 is also executed as time-triggered interrupt routines to be triggered every predetermined time intervals such as 10 milliseconds. The modified routine of FIG. 7 is similar to the routine of FIG. 4, except that steps S12–S15 and S21–S26 are further added. Thus, the same step numbers used to designate steps in the routine shown in FIG. 4 will be applied to the corresponding step numbers used in the modified routine shown in FIG. 7, for the purpose of comparison of the two different interrupt routines. Steps S12–S15 and S21–S26 will be hereinafter described in detail with reference to the accompanying drawings, while detailed description of steps S1 through S7 will be omitted because the above description thereon seems to be self-explanatory.

After VTC-malfunction detection step S1 of FIG. 7, step S12 occurs.

At step S12, hydraulic pressure $P_L$ of pressurized oil from oil pump 31 is detected by means of hydraulic pressure sensor 36 (see FIG. 2). Instead of using hydraulic pressure sensor 36, hydraulic pressure $P_L$ of pressurized oil from oil pump 31 may be estimated based on engine speed Ne and/or engine oil temperature $T_{oil}$.

At step S13, a check is made to determine whether hydraulic pressure $P_L$ is less than first threshold value A. When the answer to step S13 is affirmative (YES), the routine proceeds to step S14. Conversely when the answer to step S13 is negative (NO), the routine proceeds to step S2.

At step S14, a check is made to determine whether hydraulic pressure $P_L$ is less than second threshold value B (<A). When the answer to step S14 is affirmative (YES), the routine proceeds to step S15. Conversely when the answer to step S14 is negative (NO), the routine proceeds to step S21.

At step S15, a check is made to determine whether hydraulic pressure $P_L$ is less than third threshold value C (<B). When the answer to step S15 is affirmative (YES), the routine proceeds to step S25. Conversely when the answer to step S15 is negative (NO), the routine proceeds to step S23.

When hydraulic pressure $P_L$ is greater than or equal to first threshold value A, that is, in case of $P_L \geqq A$ (see the first case ① in FIG. 8) and thus the answer to step S13 is negative (NO), through a series of steps S2–S6 a desired valve timing of the unfailed VTC mechanism functioning properly is adjusted to the actual valve timing of the failed VTC mechanism functioning improperly (see step S2), and additionally switching to high-speed cam 14*a* having the large valve-lift and working-angle characteristic is initiated if low-speed cam 14*b* is used (see step S5) or the high-speed cam operating mode is continued if high-speed cam 14*a* has already been used (see step S6).

When hydraulic pressure $P_L$ is less than first threshold value A and greater than or equal to second threshold value B, that is, in case of $B \leqq P_L < A$, (see the second case ② in FIG. 8), the routine flows from step S13 via step S14 to steps S21 and S22. VTC hydraulic pressure control valve 18 is fully closed and thus oil supply (hydraulic-pressure supply) to the unfailed VTC mechanism is stopped or inhibited (see step S21). Thereafter, VVL hydraulic pressure control valve 11 is fully opened and thus oil supply (hydraulic-pressure supply) to VVL mechanism 13 is permitted such that switching to high-speed cam 14*a* is initiated or the high-speed cam operating mode is maintained (see step S22). As a result, the valve lift and working angle of each of intake valves 15 can be increasingly compensated for or the large valve-lift and working-angle state can be maintained. That is to say, in the second case ② ($B \leqq P_L < A$), there is no valve timing adjustment that a desired valve timing of the unfailed VTC mechanism functioning properly is adjusted or brought closer to the actual valve timing of the failed VTC mechanism functioning improperly, but the valve lift and working angle of each of intake valves 15 can be increasingly compensated for or the large valve-lift and working-angle state can be maintained by means of VVL mechanism 13, thus avoiding the problem of a degradation in engine performance such as a lack in engine torque, which may occur owing to the use of low-speed cam operating mode (that is, owing to the use of the small valve-lift and working-angle characteristic).

When hydraulic pressure $P_L$ is less than second threshold value B and greater than or equal to third threshold value C, that is, in case of $C \leqq P_L < B$, (see the third case ③ in FIG. 8), the routine flows from step S13 via steps S14 and S15 to steps S23 and S24. VVL hydraulic pressure control valve 11 is fully closed and thus oil supply (hydraulic-pressure supply) to the VVL mechanism is stopped or inhibited (see step S23). Thereafter, the unfailed VTC mechanism functioning properly is rapidly adjusted or returned to or brought closer to its maximum timing-retard position, i.e., the predetermined initial position (see step S24). Such rapid return of the unfailed VTC mechanism functioning properly to the initial position (the maximum timing-retard position) is very effective to enhance the engine restartability when the engine is restarted for a brief moment after the engine has been stopped.

When hydraulic pressure $P_L$ is less than third threshold value C, that is, in case of $P_L < C$, (see the fourth case ④ in FIG. 8), the routine flows from step S13 via steps S14 and S15 to steps S25 and S26. VVL hydraulic pressure control valve 11 is fully closed and thus oil supply (hydraulic-pressure supply) to the VVL mechanism is stopped or inhibited (see step S25). At the same time, VTC hydraulic pressure control valve 18 is fully closed and thus oil supply (hydraulic-pressure supply) to the unfailed VTC mechanism functioning properly is stopped or inhibited (see step S26), and thus there is no valve timing adjustment that a desired valve timing of the unfailed VTC mechanism functioning properly is adjusted or brought closer to the actual valve timing of the failed VTC mechanism functioning improperly. After the previously-discussed four different control flows, namely the flow defined by S1→S12→S13→S2→S3→S4→S5 (or →S6), the flow defined by S1→S12→S21→S22, the flow defined by S1→S12→S13→S14→S15→S23→S24, and the flow defined by S1→S12→S13→S14→S15→S25→S26, corresponding to the respective cases ①, ②, ③, and ④ (in FIG. 8, step S7 takes place, in order to inhibit further valve timing adjustment of the unfailed VTC mechanism functioning normally properly and additionally to inhibit switching between high-speed cam 14*a* and low-speed cam 14*b* of VVL mechanism 13.

As set forth above, according to the modified fail-safe routine shown in FIGS. 7 and 8, oil supply (hydraulic-pressure supply) to VVL hydraulic pressure control valve 11 for VVL mechanism 13 and oil supply (hydraulic-pressure supply) to VTC hydraulic pressure control valve 18 for the unfailed VTC mechanism functioning properly are suitably limited or inhibited depending on the pressure level of hydraulic pressure $P_L$ discharged from oil pump 31, in the presence of a VTC mechanism malfunction. Therefore, there is no risk that the VVL mechanism and/or the unfailed VTC mechanism functioning normally begins to function improperly due to a lack in hydraulic pressure, thus enhancing the fail-safe performance. In the modified control routine, steps S1 and S3–S6 serve as a first failsafe section capable of executing a first failsafe operating mode in which at least one of the valve lift and the working angle of each of engine valves is increasingly compensated for by the VVL mechanism, when the one VTC mechanism is failed. Steps S1 and S2 serve as a second failsafe section capable of executing a second failsafe operating mode in which a valve timing of the unfailed VTC mechanism of the VTC mechanisms is compensated for and brought closer to a valve timing of the failed VTC mechanism. Steps S1, S12, S13, S14, S21 and S22 serve as a third failsafe section capable of executing a third failsafe operating mode in which hydraulic pressure supply to the unfailed VTC mechanism is inhibited under a condition where the one VTC mechanism is failed and the pressure level of hydraulic pressure $P_L$ discharged from the hydraulic pressure source is less than the first threshold value A and greater than or equal to a second threshold value B. Steps S1, S12, S13, S14, S15, S23 and S24 serve as a fourth failsafe section capable of executing a fourth failsafe operating mode in which hydraulic pressure supply to the VVL mechanism is inhibited and the unfailed VTC mechanism is adjusted to a maximum timing-retard position under a condition where the one VTC mechanism is failed and the pressure level of hydraulic pressure $P_L$ discharged from the hydraulic pressure source is less than the second threshold value B and greater than or equal to a third threshold value C. Steps S1, S12, S13, S14, S15, S25 and S26 serve as a fifth failsafe section capable of executing a fifth failsafe operating mode in which hydraulic pressure supply to the VVL mechanism and hydraulic pressure supply to the unfailed VTC mechanism are both inhibited under a condition where the one VTC mechanism is failed and the pressure level of hydraulic pressure $P_L$ discharged from the hydraulic pressure source (oil pump 31) is less than the third threshold value C.

In the shown embodiment, the variable valve operating system of the invention is installed on the intake valve side of a V-type, double-overhead-camshaft internal combustion engine with two camshafts per cylinder bank, and a first one of two VTC mechanisms is associated with intake valves arranged in the first cylinder bank, and the second VTC mechanism is associated with intake valves arranged in the second cylinder bank. It will be appreciated that the fundamental concept of the fail-safe operation achieved by the variable valve operating system of the invention may be applied to a two-bank internal combustion engine employing a first VTC mechanism associated with exhaust valves arranged in the first cylinder bank, a second VTC mechanism associated with exhaust valves arranged in the second cylinder bank, and a VVL mechanism associated with the exhaust valves arranged in the two cylinder banks. In this case, in order to avoid unstable engine combustion, the ECU has to execute a failsafe operating mode in which at least one of the valve lift and the working angle of each of exhaust valves is properly compensated for by the VVL mechanism. Also, in order to avoid a degraded engine performance occurring owing to unbalanced valve timings of the exhaust valves in the two cylinder banks, the ECU has to execute a failsafe operating mode in which a valve timing of the unfailed VTC mechanism is compensated for and brought closer to a valve timing of the failed VTC mechanism.

In the shown embodiment, in the presence of a malfunction of a certain VTC mechanism of a plurality of VTC mechanisms, a valve lift and a working angle of each of engine valves are both increasingly compensated for in accordance with the fail-safe operation of the invention. In lieu thereof, at least one of the valve lift and the working angle may be increasingly compensated in the presence of such a malfunction.

The variable valve operating system of the embodiment is exemplified in a V-type, double-overhead-camshaft internal combustion engine with two camshafts per cylinder bank. It will be understood that the fundamental concept of the invention can be applied to a horizontal opposed type internal combustion engine, often called "pancake engine" or a W-type internal combustion engine with four cylinder banks.

The entire contents of Japanese Patent Application No. 2003-52332 (filed Feb. 28, 2003) are incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A variable valve operating system for an internal combustion engine with at least two cylinder banks comprising:

a variable valve-lift and working-angle control mechanism that changes at least one of a valve lift and a working angle of each of engine valves arranged in each of the cylinder banks;

at least two variable valve timing control mechanisms provided for each of the cylinder banks, for changing a valve timing of each of the engine valves arranged in one bank of the cylinder banks and a valve timing of each of the engine valves arranged in the other bank independently of each other; and a control unit configured to be electronically connected to the variable valve-lift and working-angle control mechanism and the variable valve timing control mechanisms for responding a failure in one of the variable valve timing control mechanisms for failsafe purposes; the control unit comprising:

a first failsafe section capable of executing a first failsafe operating mode in which at least one of the valve lift and the working angle of each of engine valves is increasingly compensated for by the variable valve-lift and working-angle control mechanism, when the one variable valve timing control mechanism is failed.

2. The variable valve operating system as claimed in claim 1, wherein:

the control unit further comprises:

a second failsafe section capable of executing a second failsafe operating mode in which a valve timing of an unfailed variable valve timing control mechanism of the variable valve timing control mechanisms is compensated for and brought closer to a valve timing of the failed variable valve timing control mechanism.

3. The variable valve operating system as claimed in claim 1, wherein:

the variable valve-lift and working-angle control mechanism comprises a high-speed-cam and low-speed-cam switching system equipped with a high-speed cam having a predetermined large valve-lift and working-angle characteristic and a low-speed cam having a predetermined small valve-lift and working-angle characteristic, for varying both of the valve lift and the working angle by switching from one of the high-speed cam and the low-speed cam to the other;

the variable valve-lift and working-angle control mechanism initiates switching from the low-speed cam to the high-speed cam when the one variable valve timing control mechanism is failed, and holds a high-speed cam operating mode when switching to the high-speed cam has already been made.

4. The variable valve operating system as claimed in claim 2, further comprising:

a hydraulic pressure source, which is common to the variable valve-lift and working-angle control mechanism and the variable valve timing control mechanisms, for hydraulically operating the variable valve-lift and working-angle control mechanism and the variable valve timing control mechanisms; and wherein the first and second failsafe operating modes are both executed under a condition where the one variable valve timing control mechanism is failed and a pressure level of hydraulic pressure discharged from the hydraulic pressure source is greater than or equal to a first threshold value.

5. The variable valve operating system as claimed in claim 4, wherein:

the control unit further comprises:

a third failsafe section capable of executing a third failsafe operating mode in which hydraulic pressure supply to the unfailed variable valve timing control mechanism is inhibited under a condition where the one variable valve timing control mechanism is failed and the pressure level of hydraulic pressure discharged from the hydraulic pressure source is less than the first threshold value and greater than or equal to a second threshold value.

6. The variable valve operating system as claimed in claim 5, wherein:

the control unit further comprises:

a fourth failsafe section capable of executing a fourth failsafe operating mode in which hydraulic pressure supply to the variable valve-lift and working-angle control mechanism is inhibited and the unfailed variable valve timing control mechanism is adjusted to a maximum timing-retard position under a condition where the one variable valve timing control mechanism is failed and the pressure level of hydraulic pressure discharged from the hydraulic pressure source is less than the second threshold value and greater than or equal to a third threshold value.

7. The variable valve operating system as claimed in claim 6, wherein:

the control unit further comprises:

a fifth failsafe section capable of executing a fifth failsafe operating mode in which hydraulic pressure supply to the variable valve-lift and working-angle control mechanism and hydraulic pressure supply to the unfailed variable valve timing control mechanism are both inhibited under a condition where the one variable valve timing control mechanism is failed and the pressure level of hydraulic pressure discharged from the hydraulic pressure source is less than the third threshold value.

8. A variable valve operating system for an internal combustion engine comprising:

a variable valve-lift and working-angle control mechanism that changes at least one of a valve lift and a working angle of each of engine valves;

at least two variable valve timing control mechanisms that change valve timings independently of each other; and a control unit configured to be electronically connected to the variable valve-lift and working-angle control mechanism and the variable valve timing control mechanisms for responding a failure in one of the variable valve timing control mechanisms for failsafe purposes; the control unit comprising:

a first failsafe section capable of executing a first failsafe operating mode in which at least one of the valve lift and the working angle of each of engine valves is increasingly compensated for by the variable valve-lift and working-angle control mechanism, when the one variable valve timing control mechanism is failed.

9. A variable valve operating system for an internal combustion engine with at least two cylinder banks comprising:

a variable valve-lift and working-angle control mechanism that changes at least one of a valve lift and a working angle of each of engine valves arranged in each of the cylinder banks;

at least two variable valve timing control mechanisms provided for each of the cylinder banks, for changing a valve timing of each of the engine valves arranged in one bank of the cylinder banks and a valve timing of each of the engine valves arranged in the other bank independently of each other; and a control unit configured to be electronically connected to the variable valve-lift and working-angle control mechanism and the variable valve timing control mechanisms for responding a failure in one of the variable valve timing control mechanisms for failsafe purposes; the control unit comprising:

malfunction detection means for determining whether one of the variable valve timing control mechanisms is failed; and failsafe means for executing a failsafe operating mode in which at least one of the valve lift and the working angle of each of engine valves is increasingly compensated for by the variable valve-lift and working-angle control mechanism, when the one variable valve timing control mechanism is failed.

10. A method of executing failsafe functions for a variable valve operating system for a multi-bank internal combustion engine employing a variable valve-lift and working-angle control mechanism changing at least one of a valve lift and a working angle of each of engine valves arranged in each of cylinder banks, and at least two variable valve timing control mechanisms provided for each of the cylinder banks for changing a valve timing of each of the engine valves arranged in one bank of the cylinder banks and a valve timing of each of the engine valves arranged in the other bank independently of each other, the method comprising:

detecting whether one of the variable valve timing control mechanisms is failed; and executing a first failsafe operating mode in which at least one of the valve lift and the working angle of each of engine valves is increasingly compensated for by the variable valve-lift and working-angle control mechanism, when the one variable valve timing control mechanism is failed.

11. The method as claimed in claim 10, further comprising:

detecting a first phase of a cam-angle sensor signal output associated with the failed variable valve timing control mechanism and a second phase of a cam-angle sensor signal output associated with an unfailed variable valve timing control mechanism of the variable valve timing control mechanisms;

determining that the one variable valve timing control mechanism is failed when a phase difference between the first and second phases exceeds a predetermined reference value;

executing a second fail-safe operating mode in which a valve timing of the unfailed variable valve timing control mechanism is compensated for and brought closer to a valve timing of the failed variable valve timing control mechanism, when the one variable valve timing control mechanism is failed.

12. The method as claimed in claim 11, further comprising:

hydraulically operating the variable valve-lift and working-angle control mechanism and the variable valve timing control mechanisms by a common hydraulic pressure source, and wherein:

the first and second failsafe operating modes are both executed under a condition where the one variable valve timing control mechanism is failed and a pressure level of hydraulic pressure discharged from the hydraulic pressure source is greater than or equal to a first threshold value.

13. The method as claimed in claim 12, further comprising:

executing a third failsafe operating mode in which hydraulic pressure supply to the unfailed variable valve timing control mechanism is inhibited under a condition where the one variable valve timing control mechanism is failed and the pressure level of hydraulic pressure discharged from the hydraulic pressure source is less than the first threshold value and greater than or equal to a second threshold value.

14. The method as claimed in claim 13, further comprising:

executing a fourth failsafe operating mode in which hydraulic pressure supply to the variable valve-lift and working-angle control mechanism is inhibited and the unfailed variable valve timing control mechanism is adjusted to a maximum timing-retard position under a condition where the one variable valve timing control mechanism is failed and the pressure level of hydraulic pressure discharged from the hydraulic pressure source is less than the second threshold value and greater than or equal to a third threshold value.

15. The method as claimed in claim 14, further comprising:

executing a fifth failsafe operating mode in which hydraulic pressure supply to the variable valve-lift and working-angle control mechanism and hydraulic pressure supply to the unfailed variable valve timing control mechanism are both inhibited under a condition where the one variable valve timing control mechanism is failed and the pressure level of hydraulic pressure discharged from the hydraulic pressure source is less than the third threshold value.

16. A method of executing failsafe functions for a variable valve operating system for an internal combustion engine employing a variable valve-lift and working-angle control mechanism changing at least one of a valve lift and a working angle of each of engine valves, and at least two variable valve timing control mechanisms changing valve timings independently of each other, the method comprising:

detecting whether one of the variable valve timing control mechanisms is failed; and executing a first failsafe operating mode in which at least one of the valve lift and the working angle of each of engine valves is increasingly compensated for by the variable valve-lift and working-angle control mechanism, when the one variable valve timing control mechanism is failed.

* * * * *